US012414659B2

(12) United States Patent
Guenther et al.

(10) Patent No.: US 12,414,659 B2
(45) Date of Patent: Sep. 16, 2025

(54) PORTABLE URINAL FOR USE ON A PONTOON BOAT AND OUTDOOR ACTIVITIES

(71) Applicants: Joseph G. Guenther, Sevierville, TN (US); Joseph R. Guenther, Savannah, GA (US)

(72) Inventors: Joseph G. Guenther, Sevierville, TN (US); Joseph R. Guenther, Savannah, GA (US)

( * ) Notice: Subject to any disclaimer, the term of this patent is extended or adjusted under 35 U.S.C. 154(b) by 0 days.

(21) Appl. No.: 18/654,529

(22) Filed: May 3, 2024

(65) Prior Publication Data

US 2024/0366043 A1 Nov. 7, 2024

Related U.S. Application Data

(60) Provisional application No. 63/500,115, filed on May 4, 2023.

(51) Int. Cl.
*A47K 11/12* (2006.01)

(52) U.S. Cl.
CPC ..... *A47K 11/12* (2013.01)

(58) Field of Classification Search
CPC ..... A47K 11/12
USPC ..... 4/310, 476
See application file for complete search history.

(56) References Cited

U.S. PATENT DOCUMENTS

| | | | | | |
|---|---|---|---|---|---|
| RE16,764 | E * | 10/1927 | White | E03D 1/302 | 251/24 |
| 5,509,149 | A * | 4/1996 | Lynch | A47K 11/04 | 4/476 |
| 5,822,804 | A * | 10/1998 | Hauflaire | E03D 13/00 | 4/144.1 |
| 11,033,158 | B1 * | 6/2021 | Marshall | G09B 19/00 | |
| 2008/0052810 | A1 * | 3/2008 | Zeeb | A47K 11/12 | 4/144.1 |
| 2016/0128524 | A1 * | 5/2016 | Poore | A47K 11/12 | 4/144.1 |

* cited by examiner

*Primary Examiner* — Lauren A Crane
(74) *Attorney, Agent, or Firm* — Pitts Lake, LLC

(57) ABSTRACT

A freestanding urinal designed for efficient waste management and odor control incorporates a standard receptacle with a storage tank with slanted interior floor, separated by a valve mechanism for odor containment and easy maintenance. The upper section of the unit comprises a urinal receptacle. Beneath the receptacle is a tank, connected by ball valve mechanism at the bottom of the urinal. The tank is designed to collect and store liquid waste over an extended period. The interior of the tank is slanted towards the back, ensuring efficient drainage and ease of maintenance. This design choice facilitates the complete emptying of the tank when required, preventing residue buildup and aiding in cleanliness. A ball valve, situated between the urinal and the tank, acts as a barrier to prevent odors from the tank from permeating the surrounding area.

14 Claims, 5 Drawing Sheets

PORTABLE URINAL FOR USE ON A PONTOON BOAT AND OUTDOOR ACTIVITIES

CROSS-REFERENCE TO RELATED APPLICATIONS

This Application claims the benefit of the filing date of U.S. Provisional Patent Application Ser. No. 63/500,115, filed May 4, 2023, the entire content of which is herein incorporated.

STATEMENT REGARDING FEDERALLY SPONSORED RESEARCH OR DEVELOPMENT

Not Applicable

BACKGROUND OF THE INVENTION

1. Field of Invention

The present invention pertains generally to portable marine urinals and, more particularly, to free-standing urinals for use on and with pontoon boats and in connection with outdoor activities generally.

2. Description of the Related Art

There have been previous attempts to provide portable marine urinals and, more particularly, free-standing urinals for use on pontoon boats and in outdoor activities. Previous attempts to address this need suffer from a variety of drawbacks and limitations.

Among the previous attempts to provide solutions in this technology space, U.S. Pat. No. 9,199,701, for example, discloses a pontoon boat that includes a privacy enclosure mounted on the deck. The privacy enclosure has a bottom section secured to the deck, with a rigid construction including a rigid rear bottom wall, a rigid left bottom wall, a rigid right bottom wall and a rigid front bottom wall. The rigid front bottom wall has a lower door opening therein. A rigid lower door panel is hingedly attached to the rigid front bottom wall. A top section of the enclosure has a rigid construction including a rigid rear top wall, a rigid left top wall, a rigid right top wall, a rigid roof, and a rigid front top wall. The rigid front top wall has an upper door opening therein with a rigid upper door panel hingedly attached to the rigid front upper wall. The top section is telescopically moveable in a vertical orientation relative to the bottom section between a retracted position and an extended position.

U.S. Pat. No. 11,325,683 discloses a urinal for a boat, wherein the urinal includes an outer shell that has an enlarged opening for accepting liquids (e.g. urine) and a drain. The drain is interfaced to an opening on a bottom surface of the outer shell for draining the liquids away from the boat. In some embodiments, there is a support unit for installing the urinal into an orifice (e.g. fishing pole holder) of the boat.

Similarly, U.S. Patent Application Publication No. 2001/0044952 discloses a portable toilet for marine craft securely located on the deck of a boat, including a privacy cover. The toilet includes a seat assembly and a box-shaped housing for a portable toilet. A support brace connects the boat seat assembly to the housing. The boat seat assembly includes a boat seat, a boat seat back, and the support brace, made up of first and second support members hinged together. The first member connects the boat seat back to the second support member. The inner surface of the second support member defines a seat receiving portion for the boat seat. The portable marine privacy toilet can also have a swivel attached to the bottom for allowing the toilet to be vertically pivoted, and a clamp for removably fastening the privacy cover to the toilet.

Patents illustrating aspects of the related art include the following:

TABLE 1

| Patent No. | Issue Date | Inventor(s) |
|---|---|---|
| 3,986,215 | 1976 Oct. 19 | Amalfitano |
| 4,883,016 | 1989 Nov. 28 | Larson |
| 5,848,443 | 1998 Dec. 15 | Waugh |
| 6,507,958 | 2003 Jan. 21 | Tagg |
| 6,910,230 | 2005 Jun. 28 | Schimmel |
| 7,249,568 | 2007 Jul. 31 | Cultrara |
| 7,299,511 | 2007 Nov. 27 | Quan |
| 7,334,273 | 2008 Feb. 26 | Thomas |
| 7,418,919 | 2008 Sep. 2 | Smith et al. |
| 8,181,284 | 2012 May 22 | Parker |
| 8,499,371 | 2013 Aug. 6 | Becker |
| 8,650,669 | 2014 Feb. 18 | Kolter |
| 9,603,737 | 2017 Mar. 28 | Jenkin |
| 10,682,025 | 2020 Jun. 16 | Rudolph |
| 11,325,683 | 2022 May 10 | Fleming et al. |

Further, other published patent applications illustrating aspects of the related art include the following:

TABLE 2

| Publication No. | Publication Date | Inventor(s) |
|---|---|---|
| 2003/0140409 | 2003 Jul. 31 | Johnson |
| 2008/0163411 | 2008 Jul. 10 | Brown et al. |
| 2010/0058518 | 2010 Mar. 11 | Bourgeois et al. |
| 2021/0249988 | 2021 Aug. 12 | Wickramasekera |
| 2021/0267787 | 2021 Sep. 2 | Nazemi |

A need is still felt for device or assembly that provides a secure, stable receptacle for the deposition of liquid waste on a pontoon boat and in similar settings.

SUMMARY OF THE INVENTION

Disclosed herein are various example embodiments of the present general inventive concept.

In some example embodiments of the present general inventive concept, a freestanding urinal, designed for efficient waste management and odor control, incorporates a standard receptacle with a storage tank with slanted interior floor, separated by a valve mechanism for odor containment and easy maintenance. The upper section of the unit comprises a urinal receptacle. Beneath the receptacle is a tank, connected by ball valve mechanism at the bottom of the urinal. The tank is designed to collect and store liquid waste over an extended period. The interior of the tank is slanted towards the back, ensuring efficient drainage and ease of maintenance. This design choice facilitates the complete emptying of the tank when required, preventing residue buildup and aiding in cleanliness. A ball valve, situated between the urinal and the fluid tank, acts as a barrier to prevent odors from the tank from permeating the surrounding area.

In some example embodiments of the present general inventive concept, a urinal assembly comprises of a receptacle positioned above a fluid tank, with a fluid flow duct between the receptacle and the fluid tank permitting passage of fluid from the receptacle into the fluid tank, and with a drain with valve or damper regulating passage of fluid from the receptacle to the fluid flow duct; a neck and T-handle positioned generally above the receptacle; a drain and drain valve positioned on the fluid tank and adapted to facilitate emptying of the fluid tank; and one or more lifting handles positioned on an exterior surface of the fluid tank and adapted to facilitate movement of the urinal assembly.

Thus, in some example embodiments of the present general inventive concept, a portable urinal for use in outdoor settings comprises a liquid-capture vessel, a base portion including a fluid tank and a fluid flow duct connecting the liquid-capture vessel and the fluid tank and permitting passage of fluid from the liquid-capture vessel into the fluid tank; and a handle portion.

In some embodiments, the portable urinal is approximately 50 to 60 inches in height.

Some embodiments further comprise a mechanism that flushes or drains liquid from the liquid-capture vessel to the fluid tank.

In some embodiments, the handle portion includes means for operating the flushing mechanism.

In some embodiments, the base portion includes at least one handle.

In some embodiments, the base portion includes at least two handles positioned on opposing sides of said base portion.

In some embodiments of the present general inventive concept, a novel freestanding urinal designed for efficient waste management and odor control incorporates a standard receptacle with a storage tank with slanted interior floor, separated by a valve mechanism for odor containment and easy maintenance. The upper section of the unit comprises a standard urinal receptacle, designed for ease of use. The receptacle's dimensions and ergonomics are in line with conventional urinals, ensuring user familiarity and comfort. Beneath the receptacle is a tank (generally from 5 gallons to 10 gallons in interior volume or capacity), connected by ball valve mechanism at the bottom of the urinal. The tank is designed to collect and store liquid waste over an extended period. The interior of the tank is slanted towards the back, ensuring efficient drainage and ease of maintenance. This design choice facilitates the complete emptying of the tank when required, preventing residue buildup and aiding in cleanliness. A ball valve, situated between the urinal and the tank, acts as a barrier to prevent odors from the tank from permeating the surrounding area. The valve is controlled by a stem extension handle, which users can operate to open (by pressing down) or close (by pulling up). Above the urinal section, a stability handle is provided. This handle allows users to maintain balance and comfort during use, enhancing the overall user experience.

In some embodiments, a freestanding urinal designed for efficient waste management and odor control, comprises a urinal receptacle configured to receive liquid waste, a fluid tank configured to receive liquid waste from the urinal receptacle, a duct connecting the urinal receptacle and the fluid tank, the duct configured to permit the passage of liquid waste from the urinal receptacle into an interior volume of the fluid tank, and a ball valve situated proximate the duct and configured to control passage of liquid waste from the urinal receptacle into the interior volume of the fluid tank.

Some embodiments further include a stem extension handle configured to control the ball valve.

Some embodiments further include a stability handle positioned near the urinal receptacle.

In some embodiments, the freestanding urinal has a defined front and back, the front defined by an aperture permitting access to the urinal receptacle, and wherein the fluid tank is slanted towards the back of the freestanding urinal, whereby liquid waste within the fluid tank tends to collect near the back of the freestanding urinal.

BRIEF DESCRIPTION OF THE DRAWING FIGURES

The above-mentioned and additional features of the invention will become more clearly understood from the following detailed description of the invention read together with the drawings in which.

DETAILED DESCRIPTION

Various example embodiments of the present general inventive concept provide a free-standing urinal for use on a pontoon boat and with outdoor activities, the urinal comprising a receptacle positioned above a fluid tank, with a fluid flow duct between the receptacle and the fluid tank permitting passage of fluid from the receptacle into the fluid tank, and with a drain with damper regulating passage of fluid from the receptacle to the fluid flow duct. Urinals constructed according to example embodiments of the present general inventive concept also may include a neck and T-handle positioned generally above the receptacle; a drain and drain valve positioned on the fluid tank and adapted to facilitate emptying of the fluid tank; and one or more lifting handles positioned on one or more exterior surfaces of the fluid tank—the lifting handles being adapted to ease and facilitate movement of the urinal.

Thus, in some example embodiments of the present general inventive concept, a freestanding urinal, designed for efficient waste management and odor control, incorporates a standard receptacle with a storage tank with slanted interior floor, separated by a valve mechanism for odor containment and easy maintenance. The upper section of the unit comprises a urinal receptacle. Beneath the receptacle is a tank, connected by ball valve mechanism at the bottom of the urinal. The tank is designed to collect and store liquid waste over an extended period. The interior of the tank is slanted towards the back, ensuring efficient drainage and ease of maintenance. This design choice facilitates the complete emptying of the tank when required, preventing residue buildup and aiding in cleanliness. A ball valve, situated between the urinal and the fluid tank, acts as a barrier to prevent odors from the tank from permeating the surrounding area.

Figure 1:
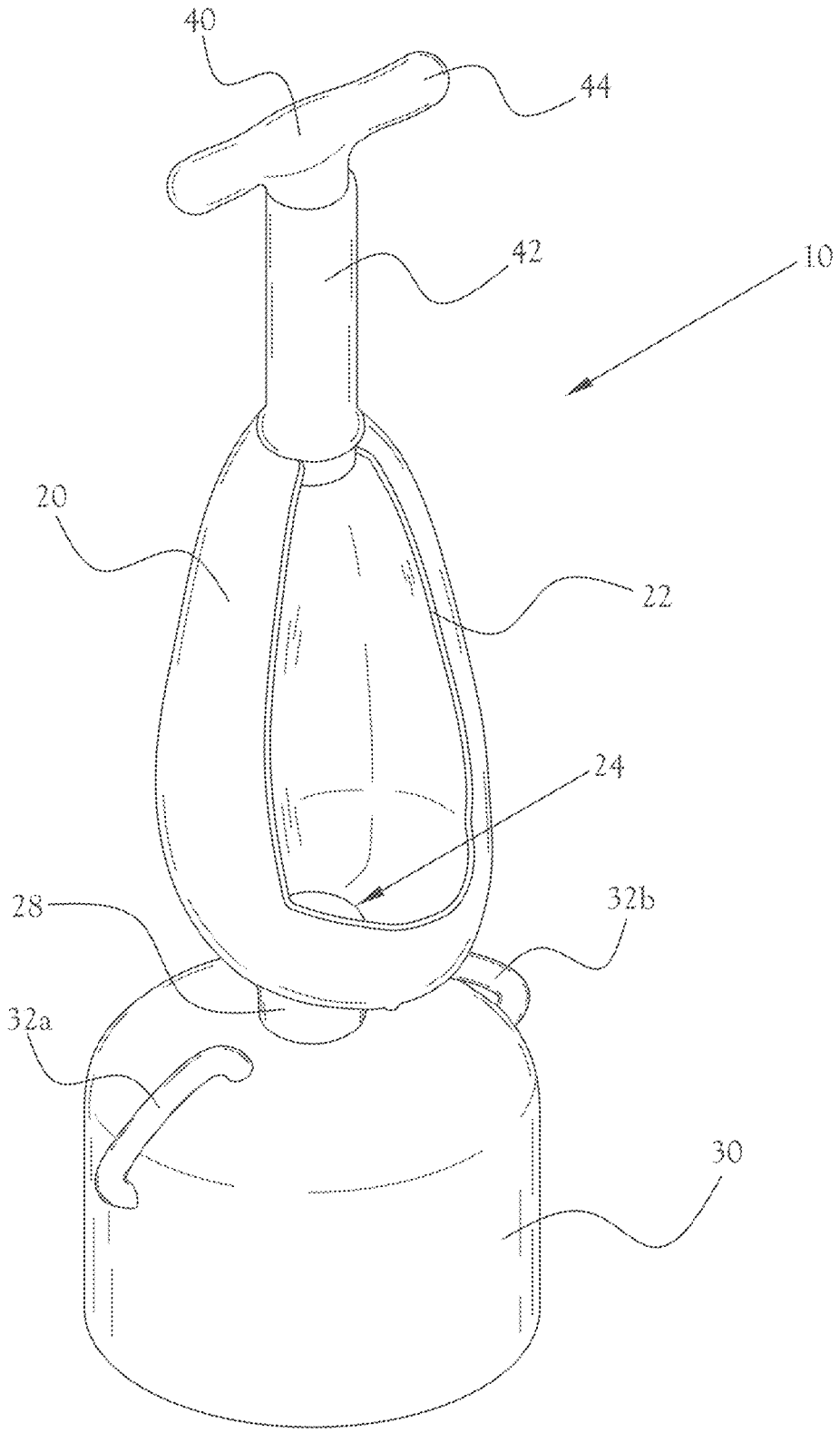
FIG. 1 is a perspective view of an assembly according to one example embodiment of the present general inventive concept.

Turning to the Figures, FIG. 1 shows a urinal assembly according to one example embodiment of the present general inventive concept, showing a free-standing urinal assembly 10 for use on a pontoon boat, the urinal assembly 10 comprising a liquid-capture vessel or receptacle 20 positioned above a fluid tank 30. As shown in FIG. 1, the liquid-capture vessel 20 includes a lid 22 defining an aperture providing access to the interior volume generally defines by the substantially egg-shaped body of the liquid-capture vessel 20. A fluid flow duct 28 connects the liquid-capture vessel 20 and the fluid tank 30, permitting passage of fluid from the liquid-capture vessel 20 into the fluid tank 30. A drain with valve or damper 24 regulates passage of fluid from the liquid-capture vessel 20 into the fluid flow duct 28 and thence into the fluid tank 30. In some embodiments, a ball valve mechanism located near the bottom of the liquid-capture vessel 20, regulates passage of fluid from the liquid-capture vessel 20 into the fluid flow duct 28 and thence into the fluid tank 30.

The illustrated example embodiment urinal assembly 10 also includes T-handle portion 40, comprising a neck 42 and handle bars 44, positioned generally above the liquid-capture vessel 20. Some embodiments include a flushing mechanism, and in some embodiments, the T-handle portion 40 includes means for operating the flushing mechanism. A drain and drain valve (not pictured in FIG. 1) are positioned on the fluid tank 30 and adapted to facilitate emptying of the fluid tank 30. The illustrated example embodiment shown in FIG. 1, two lifting handles 32*a* and 32*b* are positioned on opposing sides of the exterior surface of the fluid tank 30; these lifting handles 32*a* and 32*b* facilitate movement of the urinal.

Figure 3:
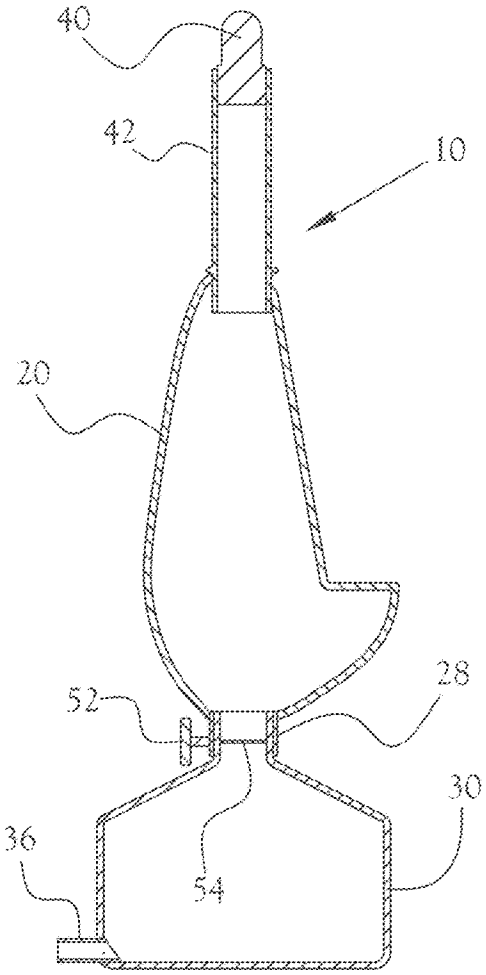
FIG. 3 is a section view of the example embodiment show in FIG. 1, FIG. 2A, and FIG. 2B.
Figure 2B:
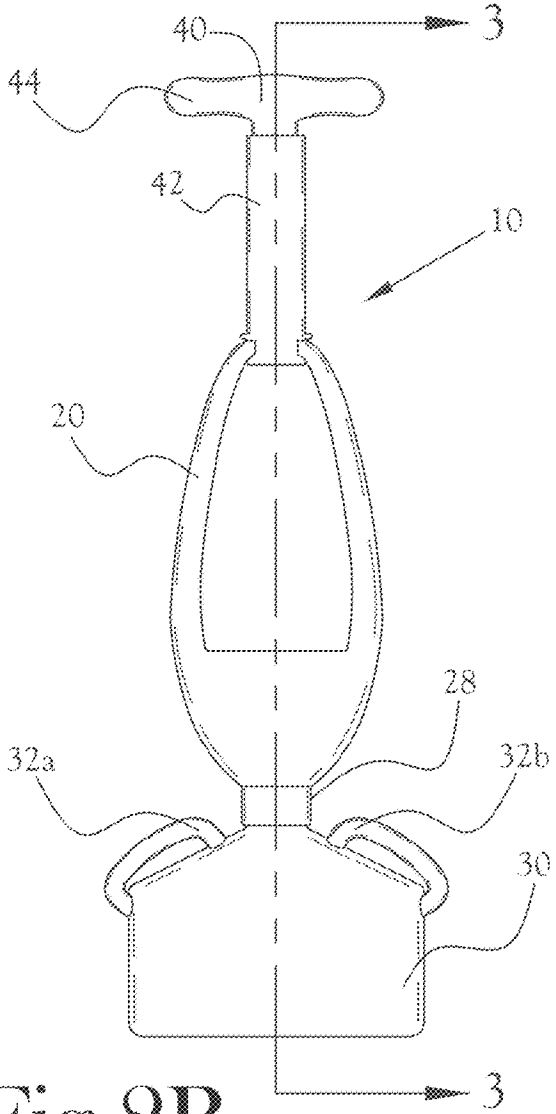
FIG. 2B is a front view of the example embodiment shown in FIG. 1 and in FIG. 2A, showing the line along which the section view in FIG. 3 is taken.
Figure 2A:
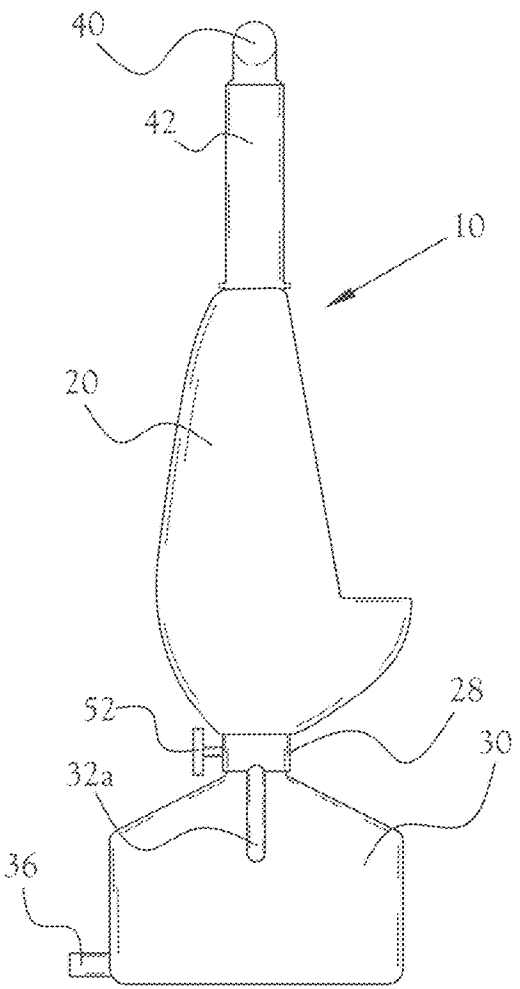
FIG. 2A is a side view of the example embodiment shown in FIG. 1.

As described above, generally a drain with valve or damper 24 regulates passage of fluid from the liquid-capture vessel 20 into the fluid flow duct 28 and thence into the fluid tank 30. FIG. 2A presents a side view of the example embodiment shown in FIG. 1. FIG. 2A shows the drain 36 near the base of the fluid tank 30, discussed above. FIG. 2A also shows a check valve handle 52, positioned on an exterior surface of the fluid flow duct 28. FIG. 2B presents a front view of the same example embodiment shown in in FIG. 2A, showing the line along which the section view in FIG. 3 is taken. As shown in the section view of FIG. 3, a fluid check valve 54 is positioned within the fluid flow duct 28; the check valve handle 52 is in communication with, and typically in mechanical connection with, the fluid check valve 54, such that a user is able to manipulate the check valve handle 52 in order to move the fluid check valve 54 between an open state and a closed state. The check valve handle 52 and the fluid check valve 54 enable a user to control the passage of fluid through the fluid flow duct 28; when the fluid check valve 54 is in its open state, fluid is able to flow from the liquid-capture vessel 20, through the fluid flow duct 28, and into the fluid tank 30; and when the fluid check valve 54 is in its closed state, the passage of fluid from the liquid-capture vessel 20, through the fluid flow duct 28, and into the fluid tank 30 is inhibited. Further, when the fluid check valve 54 is in its closed state, the closed fluid check valve 54 generally inhibits the escape of noxious or undesired odors and fumes from the interior of the fluid tank 30.

Figure 4B:
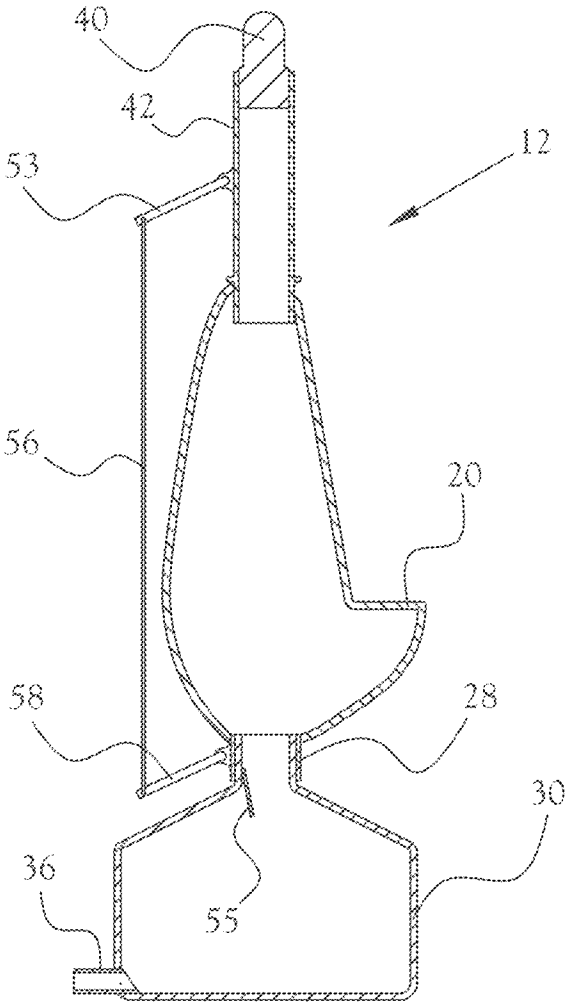
FIG. 4B is a second section view of the example embodiment shown in FIG. 4A.
Figure 4A:
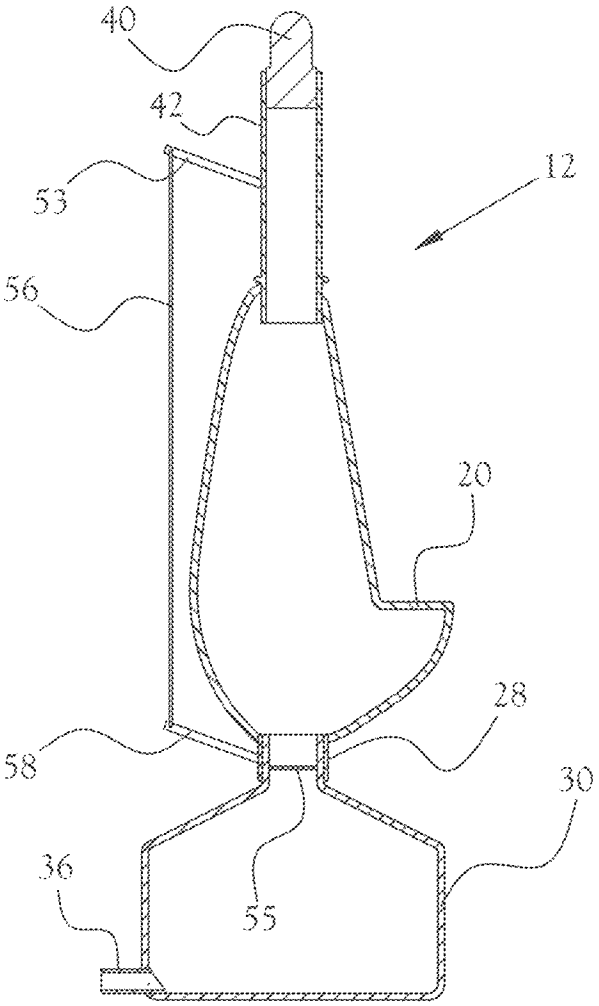
FIG. 4A is a section view of an assembly according to another example embodiment of the present general inventive concept.

FIG. 4A presents a section view of an assembly according to another example embodiment of the present general inventive concept; FIG. 4B shows a second section view of the same example embodiment. As shown in FIGS. 4A and 4B, in this second embodiment, a valve handle 53 positioned near the T-handle portion 40 allows a user to manipulate a fluid check valve 55 positioned within the fluid flow duct 28. A rigid connector member 56 and a lower actuator member 58 provide mechanical communication between the valve handle 53 and the fluid check valve 55. Manipulation of the valve handle 53 in turn moves the rigid connector member 56 and the lower actuator member 58 to move the fluid check valve 55 between an open state and a closed state, thereby controlling the passage of fluid through the fluid flow duct 28.

Figure 5:
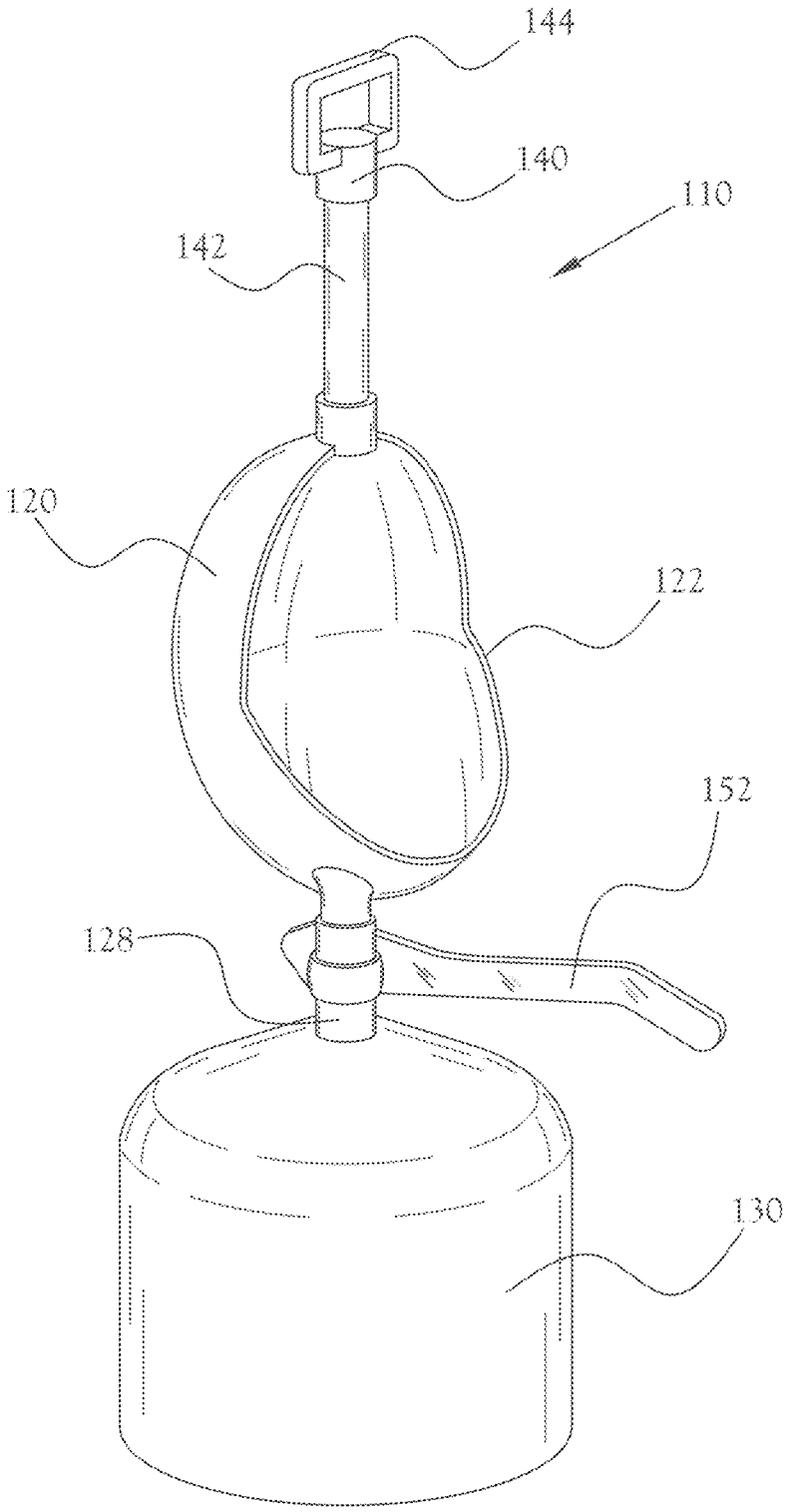
FIG. 5 is a perspective view of an assembly according to another example embodiment of the present general inventive concept.
Figure 6B:
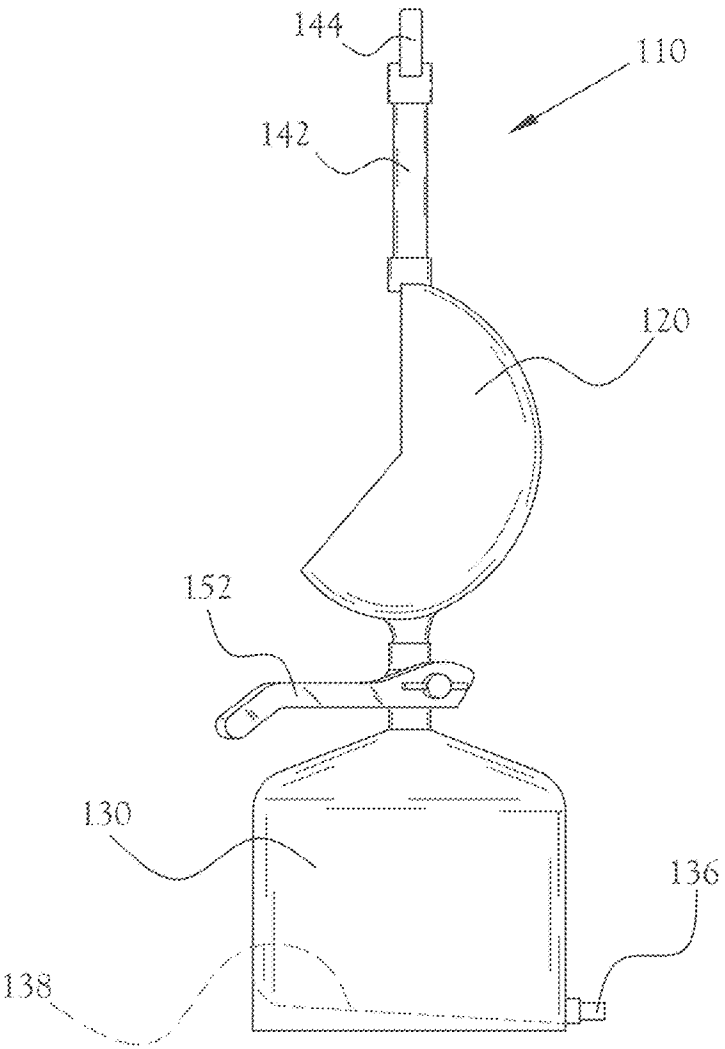
FIG. 6B is a side view of the example embodiment shown in FIG. 5 and in FIG. 6A.
Figure 6A:
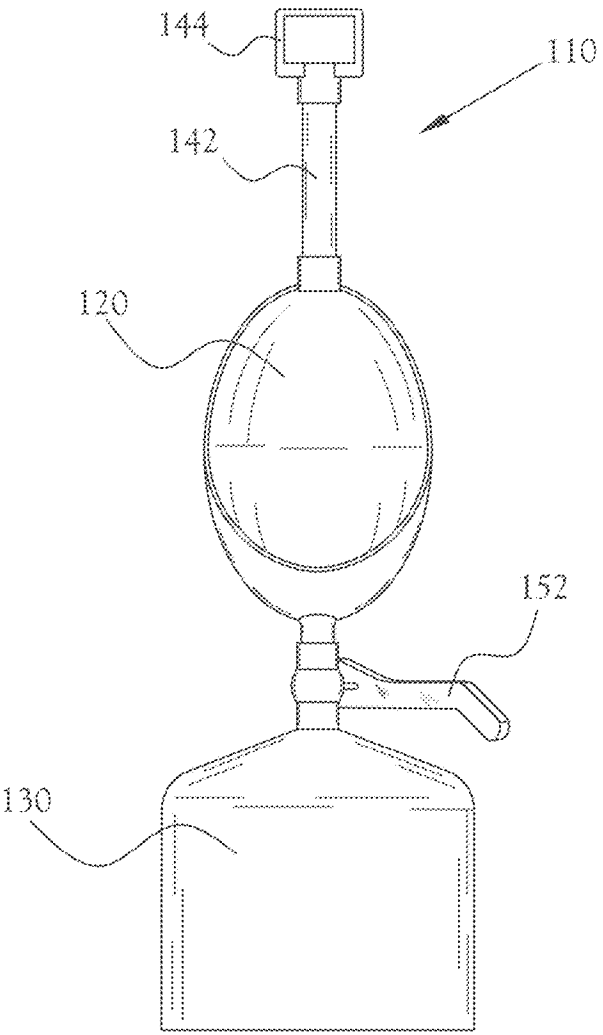
FIG. 6A is a front view of the example embodiment shown in FIG. 5.

FIG. 5 presents a perspective view of an assembly according to another example embodiment of the present general inventive concept. FIG. 6A shows a front view of the same example embodiment shown in FIG. 5, and FIG. 6B presents a side view of the same example embodiment. As shown in the Figures, the assembly 110 comprises a liquid-capture vessel or receptacle 120 positioned above a storage tank 130. The receptacle 120 includes a lid 122 defining an aperture providing access to the interior volume generally defines by the body of the receptacle 120. A fluid flow duct 128 connects the receptacle 120 and the tank 130, permitting passage of fluid from the receptacle 120 into the tank 130. The tank is designed to collect and store liquid waste over an extended period. As shown in phantom in FIG. 6B, the interior of the tank 130 includes a floor 138 that is slanted towards the back of the tank 130 (and also the back of the assembly 110), ensuring efficient drainage and ease of maintenance. The slanted or sloping floor of the storage tank 130 facilitates the complete emptying of the tank 130 when required (with stored fluid draining to a drain port 136, shown in FIG. 6B), preventing residue buildup and aiding in cleanliness.

Within the fluid flow duct 128, a ball valve regulates passage of fluid from the receptacle 120 into the tank 130. A ball valve, situated between the receptacle 120 and the tank 130, acts as a barrier to prevent odors from the tank from permeating the surrounding area. The valve is controlled by a stem extension handle 152 (which, as shown in FIG. 5 and in FIG. 6A, extends away from the fluid flow duct 128 for ease of access by a user). Generally, users operate the stem extension handle 152 to open (by pressing down) or close (by pulling up) the ball valve. Above the urinal/receptacle section of the assembly 110, a stability portion 140, with a neck 142 and stability handle 144, is provided. The handle 144 allows users to maintain balance and comfort during use, enhancing the overall user experience.

The foregoing detailed description of example embodiments of fluid check valves and subassemblies for manipulating and controlling fluid check valve is provided to assist the reader in gaining a comprehensive understanding of the structures and fabrication techniques described herein. Various changes, modification, and equivalents of the structures and techniques described herein will be apparent to those of ordinary skill in the art, and these changes, modification, and equivalents are contemplated by the present general inventive concept.

In some embodiments of the present general inventive concept, a novel freestanding urinal designed for efficient waste management and odor control incorporates a standard receptacle with a storage tank with slanted interior floor, separated by a valve mechanism for odor containment and easy maintenance. The upper section of the unit comprises a standard urinal receptacle, designed for ease of use. The receptacle's dimensions and ergonomics are in line with conventional urinals, ensuring user familiarity and comfort. Beneath the receptacle is a tank (generally from 5 gallons to 10 gallons in interior volume or capacity), connected by ball valve mechanism at the bottom of the urinal. The tank is designed to collect and store liquid waste over an extended period. The interior of the tank is slanted towards the back, ensuring efficient drainage and ease of maintenance. This design choice facilitates the complete emptying of the tank when required, preventing residue buildup and aiding in cleanliness. A ball valve, situated between the urinal and the fluid tank, acts as a barrier to prevent odors from the tank from permeating the surrounding area. The valve is controlled by a stem extension handle, which users can operate to open (by pressing down) or close (by pulling up). Above the urinal section, a stability handle is provided. This handle allows users to maintain balance and comfort during use, enhancing the overall user experience.

A freestanding urinal is optimal for use in locations where traditional plumbing or portable bathrooms are not feasible or cost-effective. Its portability and self-contained design make it suitable for small outdoor events, remote locations, pontoon boats, and temporary setups.

Thus, in some example embodiments of the present general inventive concept, a portable urinal for use on a pontoon boat and with outdoor activities comprises a liquid-capture vessel; a base portion including a fluid tank and a fluid flow duct connecting the liquid-capture vessel and the fluid tank and permitting passage of fluid from the liquid-capture vessel into the fluid tank; and a handle portion.

In some embodiments, the portable urinal is approximately 50 to 60 inches in height. In some embodiments, the portable urinal is approximately 52 inches in height. In some embodiments, the portable urinal is approximately 58 inches in height.

Some embodiments further comprising a flushing mechanism. In some embodiments, the handle portion includes means for operating the flushing mechanism.

In some embodiments, the base portion includes at least one handle. In some embodiments, the base portion includes at least two handles positioned on opposing sides of said base portion.

In some embodiments, a freestanding urinal designed for efficient waste management and odor control, comprises a urinal receptacle configured to receive liquid waste, a fluid tank configured to receive liquid waste from the urinal receptacle, a duct connecting the urinal receptacle and the fluid tank, the duct configured to permit the passage of liquid waste from the urinal receptacle into an interior volume of the fluid tank, and a ball valve situated proximate the duct and configured to control passage of liquid waste from the urinal receptacle into the interior volume of the fluid tank.

Some embodiments further include a stem extension handle configured to control the ball valve.

Some embodiments further include a stability handle positioned near the urinal receptacle.

In some embodiments, the freestanding urinal has a defined front and back, the front defined by an aperture permitting access to the urinal receptacle, and wherein the fluid tank is slanted towards the back of the freestanding urinal, whereby liquid waste within the fluid tank tends to collect near the back of the freestanding urinal.

It should be noted that the foregoing detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A portable urinal configured to be installed on a pontoon boat, the portable urinal comprising:

a liquid-capture vessel;

a base portion including a fluid tank and a fluid flow duct connecting the liquid-capture vessel and the fluid tank and permitting passage of fluid from the liquid-capture vessel into the fluid tank; and a handle portion positioned above the liquid-capture vessel, wherein the handle portion comprises a neck and a handle bar formed on top of the neck.

2. The portable urinal of claim 1, wherein the portable urinal is approximately 50 to 60 inches in height.

3. The portable urinal of claim 1, further comprising a flushing mechanism.

4. The portable urinal of claim 3, wherein the handle portion includes means for operating the flushing mechanism.

5. The portable urinal of claim 1, wherein the base portion includes at least one handle.

6. The portable urinal of claim 5, wherein the base portion includes at least two handles positioned on opposing sides of said base portion.

7. The portable urinal of claim 1, wherein the interior of the fluid tank is slanted towards a back of the portable urinal, and wherein a side portion proximate the back is a drainage outlet.

8. A freestanding urinal designed for efficient waste management and odor control, comprising:

a urinal receptacle configured to receive liquid waste;

a fluid tank configured to receive liquid waste from the urinal receptacle;

a duct connecting the urinal receptacle and the fluid tank, the duct configured to permit the passage of liquid waste from the urinal receptacle into an interior volume of the fluid tank;

a stability handle comprising a neck and a handle bar positioned on top of the neck; and a ball valve situated proximate the duct and configured to control passage of liquid waste from the urinal receptacle into the interior volume of the fluid tank.

9. The freestanding urinal of claim 8, further comprising a stem extension handle configured to control the ball valve.

10. The freestanding urinal of claim 8, wherein the stability handle is positioned proximate the urinal receptacle.

11. The freestanding urinal of claim 8, wherein the freestanding urinal has a defined front and back, the front being defined by an aperture permitting access to the urinal receptacle, and wherein the fluid tank is slanted towards the back of the freestanding urinal, whereby liquid waste within the fluid tank tends to collect near the back of the freestanding urinal and a drainage outlet is provided on a side portion proximate the back.

12. The portable urinal of claim 1, wherein the handle portion is a T-handle.

13. The freestanding urinal of claim 10, wherein the stability handle is a T-handle.

14. A freestanding urinal configured to be installed on a movable asset, comprising:

a liquid-capture vessel;

a base portion including a fluid tank and a fluid flow duct connecting the liquid-capture vessel and the fluid tank to permit passage of fluid from the liquid-capture vessel into the fluid tank, wherein a floor of the fluid tank is slanted toward a back of the freestanding urinal, and wherein a side portion at the back includes a drainage outlet; and a handle portion positioned above the liquid-capture vessel, wherein the handle portion comprises a neck and a handle bar formed above the neck.

* * * * *